US008628177B2

(12) United States Patent
Barton et al.

(10) Patent No.: US 8,628,177 B2
(45) Date of Patent: Jan. 14, 2014

(54) METHODS, APPARATUS, AND SYSTEMS FOR SPREADING RADIATION CURABLE GEL INK

(75) Inventors: Augusto E. Barton, Palo Alto, CA (US); Anthony S. Condello, Webster, NY (US); Bryan J. Roof, Newark, NY (US)

(73) Assignee: Xerox Corporation, Norwalk, CT (US)

( * ) Notice: Subject to any disclaimer, the term of this patent is extended or adjusted under 35 U.S.C. 154(b) by 178 days.

(21) Appl. No.: 13/195,601

(22) Filed: Aug. 1, 2011

(65) Prior Publication Data

US 2013/0033549 A1 Feb. 7, 2013

(51) Int. Cl.
*B41J 2/17* (2006.01)

(52) U.S. Cl.
USPC ..... 347/84

(58) Field of Classification Search
USPC ..... 347/84, 85, 89, 93, 100, 102, 104; 427/466
See application file for complete search history.

(56) References Cited

U.S. PATENT DOCUMENTS

| | | | | |
|---|---|---|---|---|
| 7,632,546 | B2 * | 12/2009 | Odell et al. | 427/466 |
| 7,887,176 | B2 * | 2/2011 | Kovacs et al. | 347/102 |
| 8,178,169 | B2 * | 5/2012 | Domoto et al. | 427/558 |
| 8,419,179 | B2 * | 4/2013 | Roof et al. | 347/102 |
| 2008/0204538 | A1 * | 8/2008 | Kovacs et al. | 347/102 |
| 2011/0262659 | A1 * | 10/2011 | Domoto et al. | 427/558 |
| 2012/0062666 | A1 * | 3/2012 | Roof et al. | 347/102 |
| 2012/0314012 | A1 * | 12/2012 | Roof et al. | 347/102 |
| 2013/0010041 | A1 * | 1/2013 | Roof et al. | 347/102 |

* cited by examiner

*Primary Examiner* — Kristal Feggins
(74) *Attorney, Agent, or Firm* — Ronald E. Prass, Jr.; Prass LLP

(57) ABSTRACT

A radiation curable gel ink spreading system includes a print head for jetting radiation curable gel ink onto a front side of a substrate, a heated re-flow drum for contacting a back side of the substrate to heat the gel ink and cause the ink to re-flow, and at least one radiation source that irradiates the heated ink to reduce or stop re-flow. A re-flow drum temperature, amount of radiation emission per unit time, radiation source location including a substrate wrap angle with respect to the re-flow drum and/or the radiation source, a distance between a re-flow zone start and the radiation source, and a gap distance between the radiation source and the substrate, and a process speed or substrate translation speed are adjustable for achieving desired spreading characteristics.

13 Claims, 4 Drawing Sheets

METHODS, APPARATUS, AND SYSTEMS FOR SPREADING RADIATION CURABLE GEL INK

RELATED APPLICATIONS

This application is related to co-pending U.S. patent application Ser. No. 13/160,120, entitled "METHODS, APPARATUS, AND SYSTEMS FOR UV GEL INK SPREADING," the disclosure of which is incorporated herein by reference in its entirety.

FIELD OF DISCLOSURE

The disclosure relates to methods, apparatus, and systems for spreading radiation curable gel ink using backside re-flow. In particular, the disclosure relates to methods, apparatus, and systems for spreading gel ink using a temperature controlled, heated backside re-flow member that contacts a back side of a substrate to heat gel ink deposits on a front side of the substrate, and a radiation source that is configured to irradiate the gel ink to reduce or stop re-flow.

BACKGROUND

Radiation curable gel inks are advantageous over conventional liquid inks at least because they tend to form drops having less mobility than those formed by conventional inks. Gel inks are deposited onto a substrate in liquid form. The liquid gel ink drops are quickly quenched to a gel state upon contact with the substrate, and have limited mobility.

Conventional inks tend to form mobile liquid drops upon contact with a substrate. As such, substrates are typically coated and/or treated to prevent, for example, coalescence of mobile liquid ink drops. A paper substrate for use with conventional inks may be coated with materials that increase adhesion characteristics and increase surface energy, or otherwise affect chemical interaction between the paper substrate and inks. Such coatings or treatments require special operations for their application to the media, and additional cost is associated with their use. Radiation curable gel inks are desirable at least because they exhibit superior drop positioning on a variety of substrate types, regardless of how the substrates are treated. It is cost advantageous, for example, to run the same media or substrate type across multiple printing apparatuses and not to have to carry, for example, specially coated stock. Further, a printing process using digital presses and conventional presses may require different media supplies suitable for each press.

SUMMARY

It has been found that radiation curable gel ink processes may benefit from methods, apparatus, and systems for achieving adequate spread of jetted ink or ink lines to address problems including image artifacts caused by, for example, objectionable pile heights. While conventional inks such as wax inks may be leveled or spread on a substrate using a combination of heat and pressure, gel inks present unique challenges. Methods, apparatus, and systems accommodate adequate line spread, and cost effective printing processes, among other advantages, which include compensating for missing jets in an ink jet print head.

Radiation curable gel ink spreading methods may include contacting a back side of a substrate with a heated re-flow member whereby radiation curable ink deposited on a front side of the substrate re-flows. Methods may include depositing the radiation curable gel ink directly onto the front side of the substrate using an ink jet apparatus or another ink deposition system such as, for example, ink deposition systems comprising micro-electromechanical machines.

In an embodiment, methods may include irradiating the radiation curable gel ink to polymerize an amount of the gel ink. In an embodiment, the irradiating may comprise irradiating the radiation curable ink at the spreading zone, the radiation being emitted from a radiation source, whereby spreading of the re-flowed radiation curable ink is stopped. The irradiating may further comprise irradiating the radiation curable gel ink during re-flow of the ink. Methods may include separating the substrate from the re-flow member; and irradiating the re-flowed radiation curable gel ink after the heated contact member contacts the substrate. Methods may include irradiating the gel ink after the separating the substrate from the re-flow member.

Methods may include contacting the back side of the substrate with a heated re-flow member, the re-flow member being temperature controlled. In an embodiment, methods may include contacting the back side of a substrate at a spreading zone with a heated contact or re-flow member, the spreading zone being defined by an area of the substrate wherein the heated contact member transfers heat to the substrate.

In an embodiment, methods may include setting the re-flow member temperature to a temperature that will cause re-flow of the gel ink at the spreading zone when the back side of the substrate is contacted with the heated re-flow member. The temperature set point may be predetermined. For example, the re-flow member temperature may be determined based on trial and error, and observations of ink line spread.

In an embodiment, methods may include controlling spreading of the radiation curable gel ink by adjusting at least one of the set contact member temperature, a concentration of radiation emitted by the radiation source during the irradiating the radiation curable ink at the spreading zone, a location of the UV source with respect to the spreading zone, a location of the UV source with respect to the substrate, and a spreading zone dwell time.

Apparatus for spreading radiation curable gel ink deposited on a front side of a substrate may include a re-flow member, the re-flow member being heated, and the re-flow member being configured to contact a back side of the substrate. The re-flow member may be temperature-controlled, and may be in the form of a rotatable drum about which the substrate may be entrained.

In embodiment, apparatus may include a print head, the print head being configured to deposit radiation curable gel ink directly onto the front side of the substrate. The print head may be an ink jet print head. The print head may comprise micro-electromechanical machines for enhanced ink deposition. After the gel ink is deposited directly onto the substrate, the gel ink may transition to a substantially gel state. The substrate may be translated in a process direction from an ink deposition position, to a position at which heat is transferred to the ink on the substrate to cause the ink to re-flow and spread. For example, the heated re-flow member may be controlled to a temperature set point wherein the heated re-flow member transfers heat during contact with the back side of the substrate sufficient to decrease a viscosity of the ink and cause re-flow of the ink.

In embodiment, apparatus may include a radiation source, the radiation source being configured to irradiate the gel ink to polymerize an amount of the gel ink. The radiation source may be configured to irradiate the gel ink at a re-flow zone, the re-flow zone being defined by an area at which the re-flow member contacts the back side of the substrate and transfers heat therethrough to the gel ink to decrease a viscosity of the gel ink whereby the ink re-flows and spreads, wherein the irradiating reduces spreading of the re-flowed ink.

In an embodiment, the radiation source may be adjustably located a distance away from a start of a re-flow zone, with respect to a print process direction. In another embodiment, apparatus may include the radiation source being adjustably configured to emit a number of photons per unit time.

An embodiment of systems for radiation curable gel ink spreading may include a print head for depositing radiation curable gel ink directly onto a front side of a substrate; and a re-flow member for contact-heating a back side of the substrate to decreasing a viscosity of the gel ink to cause the ink to re-flow and spread on the front side of the substrate.

In an embodiment, systems may include a radiation source for irradiating the re-flowed gel ink on the front side of the substrate to polymerize an amount of the gel ink for reducing flowability of the gel ink and preventing further spreading of the ink. In another embodiment, a location of the radiation source may be adjustable for modifying an ink re-flow period, the location of the radiation source being adjustable with respect to at least one of a distance between the radiation source and the substrate, and a distance between the radiation source and the start of a re-flow zone in a process direction, the re-flow zone being defined by an area at which the re-flow member transfers heat through the substrate.

Exemplary embodiments are described herein. It is envisioned, however, that any system that incorporates features of apparatus and systems described herein are encompassed by the scope and spirit of the exemplary embodiments.

DETAILED DESCRIPTION

Figure 1:
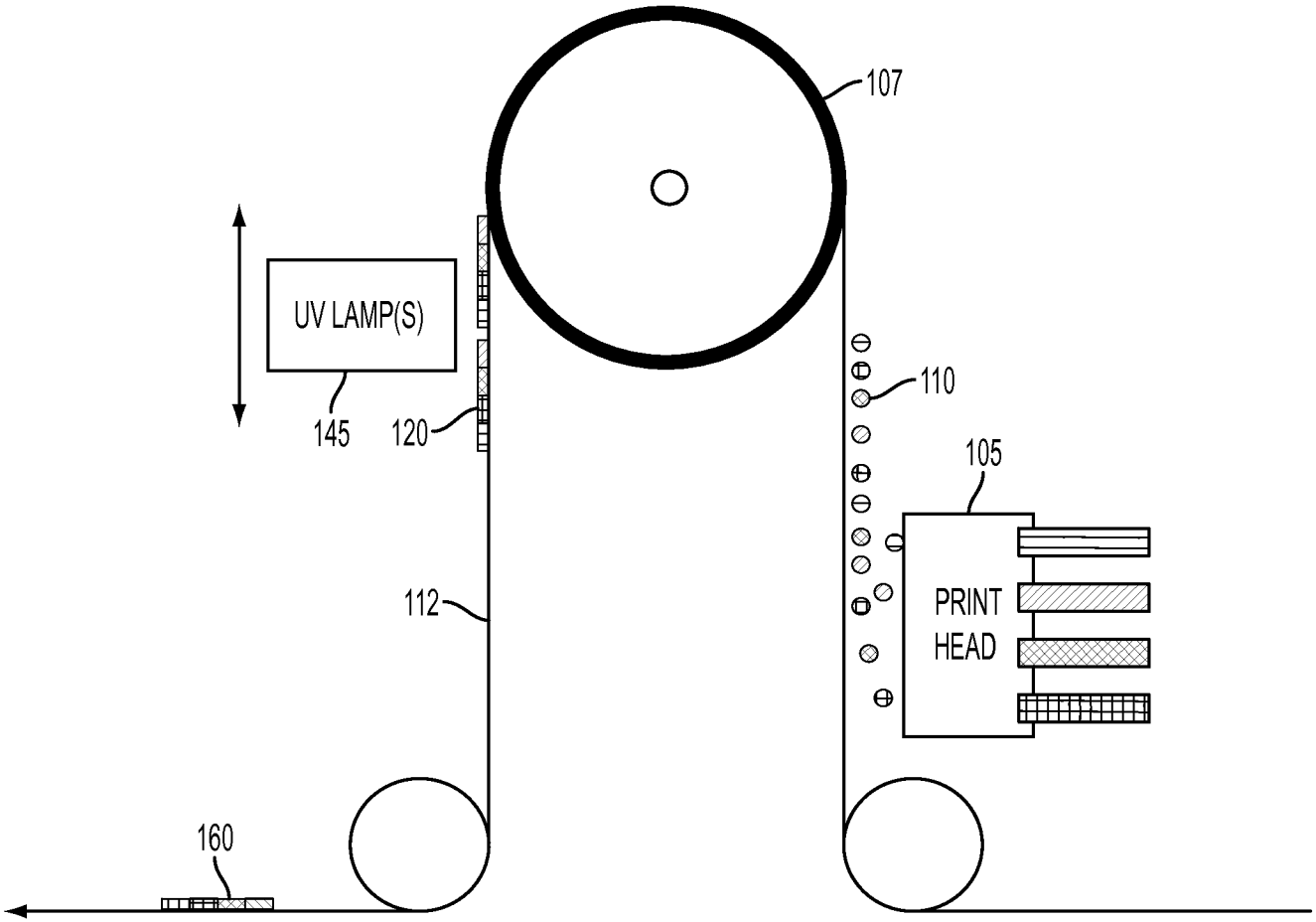
FIG. 1 shows a diagrammatical side view of a UV gel ink spreading apparatus and system in accordance with an exemplary embodiment.

Exemplary embodiments are intended to cover all alternatives, modifications, and equivalents as may be included within the spirit and scope of the apparatus and systems as described herein.

Reference is made to the drawings to accommodate understanding of methods, apparatus, and systems for radiation curable gel ink spreading. In the drawings, like reference numerals are used throughout to designate similar or identical elements. The drawings depict various embodiments and data related to embodiments of illustrative methods, apparatus, and systems for spreading radiation curable gel ink.

Radiation curable gel inks are advantageous over conventional liquid inks because they accommodate improved drop positioning, and a wider variety of substrate options without the need for special substrate coatings and/or treatments. It has been found that printing with radiation curable ink may tend to produce image artifacts attributable to, for example, objectionable pile heights. The ink may be spread, however, to reduce objectionable pile heights. While conventional methods for ink spreading rely on heat and pressure, such as with wax phase change inks, radiation curable inks present unique challenges with respect to achieving adequate ink or ink line spread.

For example, contacting radiation curable gel ink with a pressure roll, the ink being quenched to a gel state after being deposited in a substantially liquid state on to a substrate, may result in offset of the ink to the pressure member. Methods, apparatus, and systems accommodate spread of gel ink that has been heated to a liquid state, deposited onto a front side of a substrate, and quenched to a substantially gel stated upon contacting the substrate, by heating the deposited ink to cause re-flow of the ink. For example, a temperature controlled heated re-flow member may be used transfer heat to the ink by contacting a back side of the substrate.

It has been found that after the ink re-flows, the ink cools. If the period of cooling is adequate, and a surface energy difference between the ink and substrate are sufficient, the ink may draw back on itself or coalesce. A radiation source may be used to irradiate the ink during re-flow. Specifically, after the contact heating to spread the ink by lowering a viscosity of the ink so that the ink is in a substantially liquid state, a sufficient amount of radiation may be applied to the ink to prevent further mobility of the ink. Without applying radiation to the gel ink during reflow, the ink final spread state will depend on how the ink will behave during the cooling period as the ink transitions from a substantially liquid state to a substantially gel state.

While heating a back side of a substrate will spread gel ink deposited on a front side of the substrate, a spreading effectiveness is dependent on thermal characteristics of the ink and substrate, and surface energy interactions between the substrate and the ink. Methods, apparatus, and systems accommodate robust ink spreading of deposited radiation curable gel inks while avoiding drawback of the ink.

For example, radiation curable gel ink such as a ultra-violet ("UV") curable gel ink may be deposited directly onto a front side of media or a substrate. Substrate types may include, for example, bi-axially oriented polypropylene, coated paper, foils, mylar, and other suitable substrate types. The ink may be jetted onto the substrate with an ink jet print head. In an embodiment, a micro-electromechanical machine-comprising print head may be implemented for depositing the gel ink. The ink may be heated for deposition in a substantially liquid state, until being quenched upon contacting the substrate. A back side of the substrate may be contacted with a temperature controlled re-flow member. The re-flow member may be heated for transferring heat to back side of the substrate, and through the substrate to the ink deposited on the front side thereof. The heat transferred to the ink may cause the ink to transition toward a liquid state, increasing a flowability of the ink, and causing re-flow and spreading of the ink.

Ink spread may vary as a function of substrate and ink temperature, for example. Ink spread may be adjusted by adjusting a temperature of the heated re-flow member, adjusting radial or post re-flow location of the radiation source, adjusting a print process speed, adjusting a wrap angle of the substrate with respect to the re-flow member, and/or other similar means for selectively applying thermal energy to the substrate and the ink. An amount of radiation applied to the ink may be modified by adjusting a distance or gap between the substrate and the radiation source, and/or adjusting a number of photons emitted per unit time from the radiation source. The radiation source may be integral with the non-contact spreading or re-flow zone, or may be located after the spreading zone, with respect to a process direction. The gel ink may be irradiated to polymerize an amount of the ink for decreasing a flowability of the ink, stopping re-flow, and/or curing the ink. For example, the ink may be fully cured wherein a substantial amount of the deposited, re-flowed ink is polymerized.

Testing and modeling have shown that radiation curable ink re-flow by contact-heating a back side of media is reasonable at production process speeds. For example, a tested system included a re-flow member comprising a drum having a 10 inch diameter. The drum was made of aluminum. A substrate was entrained by the re-flow member, the substrate being translatable in a process direction to bring gel ink deposited by an ink jet print head to a spreading zone, and to a location at which the ink is irradiated and/or cured. The substrate comprised paper-based label stock including a backer, adhesive layer, and paper substrate.

In the tested system, the re-flow drum was set at 200° C. The process speed was set at 150 ft/min (0.76 m/s) for a spreading zone dwell time of about 524 ms. The radiation source was a UV source, and the radiation curable gel ink used was UV curable. It was found that, assuming that the UV gel ink liquefied at 75° C., a top surface of the ink reaches 75° C. at roughly 420 ms of spreading zone dwell time, and reaches about 85° C. at the full 524 ms of dwell time. Accordingly, this implies roughly over 100 ms of flow time. In this example, typical thermal values were assumed for an aluminum drum and paper based label stock. Thermal values for the ink were assumed, as was a layer thickness of about 25 microns. By modifying spreading zone dwell and re-flow drum temperature, the overall temperature and temperature gradient in the ink and label stock may be altered to fit needed conditions. Re-flowed ink may be exposed to radiation at any time within the 100+ms of flow time to fix the position of the ink and reduce or stop further re-flow.

FIG. 1 shows an embodiment of radiation curable gel ink spreading apparatus and radiation curable gel ink jetting, spreading, and curing systems. Specifically, FIG. 1 shows a UV gel ink system having a print head 105 for jetting UV curable gel ink, and a re-flow member 107. The printhead 105 may be configured, e.g., to jet or deposit UV curable gel ink onto a substrate to form a digitally printed gel ink image 110. The substrate may be a media web 112, which may be entrained about the re-flow member 107. The print head 105 may be configured to contain and/or deposit one or more inks, which may be clear, black, magenta, cyan, yellow or any other desired ink color. The print head may be an ink jet print head, or a print head comprising micro-electromechanical machine technology for enhanced ink deposition. The print head may be configured to heat radiation curable gel ink such as UV curable gel ink for depositing the ink in liquid drops to form the as-jetted image 110. The ink may be deposited directly onto the media web 112.

The re-flow member 107 may be heated. For example, the re-flow member may be temperature controlled, and a surface of the re-flow member that contacts a substrate may be heated. The re-flow member 107 may be a drum of medium mass, such as an 8 mm aluminum drum having an anodized, Teflon impregnated contact surface. The drum may be configured to be rotatable about a central longitudinal axis. The web 112 may extend to wrap around the re-flow member 107 so that a back side of the web 112 contacts the surface of the re-flow member 107, as shown. For example, the web 112 may be entrained by one or more rolls, and, e.g., the re-flow member 107.

The UV gel ink image 110 may be carried to the re-flow member 107 by the web 112, which may be translatable in a process direction. For example, the image 110 may be carried to a re-flow zone for spreading the ink of the image 110. At the re-flow zone, the web 112 may adjacent to or contacting the re-flow member 107. The re-flow member 107 may be heated for applying heat to a back side of the web 112. As the re-flow member 107 applies heat to a back side of the web 112, thermal energy may be conducted through the web 112, and to the UV gel ink, thereby causing the ink of the UV gel ink image 110 to re-flow, but without directly contacting the ink with the re-flow member.

A UV radiation source 145 may be integral with, or arranged near a re-flow zone, and may define a cure zone at which ink may be subject to UV radiation. The UV radiation source 145 may be configured to irradiate the UV gel ink image 110 while and/or after the image 110 is spread and/or leveled by heated re-flow member 107. Thus, by contact with the re-flow member 107 and by subsequent heat transfer, a viscosity of the ink may lowered, enabling the ink to re-flow and spread, during which time UV radiation may be applied to the ink to reduce mobility of the ink. For example, the ink may be spread by a re-flow process, and cured before drawback. Alternatively, the ink may be spread by a re-flow process and cured during drawback.

The ink may be cured to minimize, or preferably prevent or eliminate drawback. In an embodiment, the ink may be cured so that an amount of the ink is polymerized. For example, the ink may be minimally cured, to be finally cured in a subsequent process. In another embodiment, the ink may be substantially cured so that a substantially amount of ink in the ink image 110 is polymerized. In yet another embodiment, the ink image 110 may be cured by a UV source 145 to produce a final cured image 160.

Apparatus and systems in accordance with another embodiment may include a substrate or web translation speed adjustment system (not shown) for adjusting and/or controlling a print process speed. For example, a print process speed may be 0.76 m/s, which enables a spreading zone dwell time of about 524 ms, the dwell time being the period during which the substrate contacts the re-flow member 107, and/or heat from the re-flow member 107 is transferred to the re-flowed gel ink. With such a dwell time, a flow time may be about 100 ms. To reduce a spreading zone dwell time, the web 112 speed may be adjusted to shorten or lengthen a dwell period, and thus increase or decrease an amount of flow time. A speed of web translation may be adjusted to improve line spread of radiation curable gel ink. For example, if observed line spread and/or drawback characteristics for a particular substrate are unacceptable, a web translation speed may be adjusted, e.g., increased or decreased, to modify a line spread and/or minimize or eliminate drawback. Web translation speed may be adjusted alone or in addition to adjusting a heated re-flow member temperature, a UV source location with respect to a re-flow zone and/or the substrate, and/or an amount of applied UV radiation. An exemplary system may include a 395 nm LED array of about 1 inch in width and a 5-25 mm gap between the array and ink on a substrate. A process speed may be about 150-500 fpm, and an output of 2-16 W/cm*cm. An exemplary wrap angle may be about 90 to about 180 degrees, for example.

In methods, apparatus, and systems of an embodiment, radiation curable gel ink and/or jetted ink lines may be spread to achieve adequate pile heights, avoid image artifacts, and/or compensate for adjacent missing jets in a print head. Also, good ink drop positioning may be achieved, regardless of the type of substrate and/or how the substrate is treated, but an amount of heat transferred through a backside of a substrate depends on the thermal properties of the substrate, and a thickness of the substrate.

Figure 2:
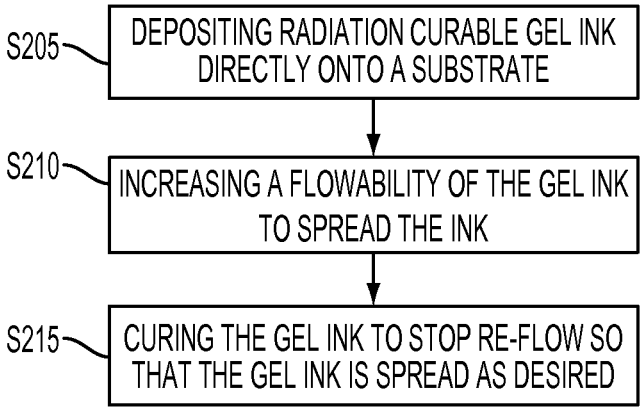
FIG. 2 shows methods for spreading radiation curable gel ink in accordance with an exemplary embodiment.

FIG. 2 shows an embodiment of radiation curable gel ink spreading methods. Specifically, FIG. 2 shows depositing radiation curable gel ink directly onto a substrate at S205. The radiation curable ink may be deposited by a radiation curable ink deposition system such as an ink jet print head. The substrate may be a paper substrate, bi-axially oriented polypropylene, coated paper, foil, mylar, or other another suitable substrate type, and may be in the form of a web. The gel ink may be heated for depositing the ink in a substantially liquid state. As the ink contacts the substrate and is quenched, the ink may transition to a substantially gel state thereafter having limited mobility.

The quenched ink, which may be deposited in ink lines to form an image, may have objectionable pile heights, for example, resulting in image artifacts. To spread the ink, reduce pile heights, and/or accommodate for missing jets, among other advantages, the quenched ink may be heated to increase a flowability of the ink by transitioning the ink toward a substantially liquid state, or causing the ink to re-flow. FIG. 2 shows increasing a flowability of the gel ink to spread the ink at S210. A re-flow period of the ink may last for about 100 ms, for example.

During re-flow, the gel ink may be cured to stop re-flow so that the gel ink is spread as desired at S215. The gel ink may be cured during the flow period so that the ink is spread as desired, and/or to prevent drawback and/or coalescence of the ink.

Figure 3:
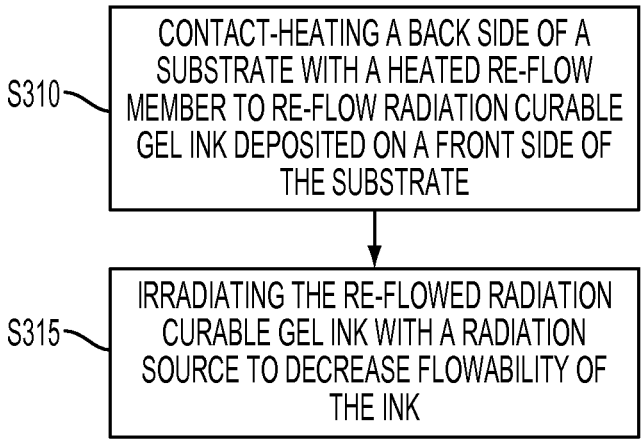
FIG. 3 shows methods for spreading UV gel ink by back side contact-heating in accordance with an exemplary embodiment.

FIG. 3 shows another embodiment of methods for spreading radiation curable gel ink. Methods of spreading radiation curable gel ink as shown in FIG. 3 include contact-heating a back side of a substrate with a heated re-flow member to re-flow radiation curable gel ink deposited on a front side of the substrate. Accordingly, the ink itself is not directly contacted by the re-flow member for heat transfer, and thus the ink is not offset to the re-flow member or a pressure member, for example. The back side of the substrate may be contacted with a re-flow member that is formed in the shape of a drum. The drum may be an aluminum drum, and the substrate may be wrapped around a portion of the drum. The re-flow drum may be set to a temperature of about 200° C., for example.

An area at which the re-flow member contacts the substrate may define a spreading zone. The spreading zone may correspond to a re-flow zone at which heat is transferred from the re-flow member to the radiation curable gel ink to cause the ink to re-flow. At the spreading zone and/or re-flow zone, the heated drum may transfer heat to the ink by way of the substrate, and the gel ink may be brought to a transition temperature. For example, radiation curable gel ink may liquefy at about 75° C. At the spreading zone, the ink deposited on the substrate may be heated to about 75° C. or above by the re-flow member contacting the back side of the substrate during a dwell time in the heating zone. If the ink reaches about 75° C. after 420 ms of dwell time at a process speed of about 0.76 m/s, and about 85° C. at a full 524 ms of dwell time for a 10 inch diameter drum, then the gel ink would re-flow for a period of about 100 ms.

To reduce or prevent drawback, and/or achieve a desired degree of ink spread, the ink may be cured during the re-flow period. For example, FIG. 3 shows irradiating the re-flowed radiation curable gel ink with a radiation source to decrease flowability of the ink at S315. The ink may be UV curable gel ink, and the radiation source may be a UV source. The UV source may be integral with or arranged adjacent to a spreading zone at a UV curing zone. For example, the UV source may be located after a spreading or re-flow zone. The UV source may be configured to emit an amount of photons per unit time that is effective to polymerize an amount of the re-flowed ink. For example, the UV source may be configured to cure the ink by polymerizing a substantial proportion of re-flowed ink at the curing zone.

Various parameters may be set and adjusted to achieve desired radiation curable gel ink drop and/or line spread and/or positioning. For example, a radiation source location may be adjusted. Specifically, a location of the radiation source with respect to the spreading zone may be adjusted to modify a flow time. For example, the radiation source may be moved closer to the spreading zone, and particularly a start of the spreading zone with respect to a process direction, to decrease re-flowed gel ink flow time. A wrap angle of the substrate with respect to the UV source may be adjusted to modify a flow time period. Further, a process speed may be adjusted to, e.g., modify a dwell time and/or a flow time of re-flowed gel ink. Further, a temperature of the re-flow member may be adjusted.

In an embodiment, an amount of radiation applied to the gel ink may be adjusted by adjusting a radiation emission rate per unit time. For example, a UV source may be adjusted to modify an amount of photons emitted per unit time. Further, the UV source location may be adjusted to modify a gap distance between the substrate and the UV source.

Figure 4:
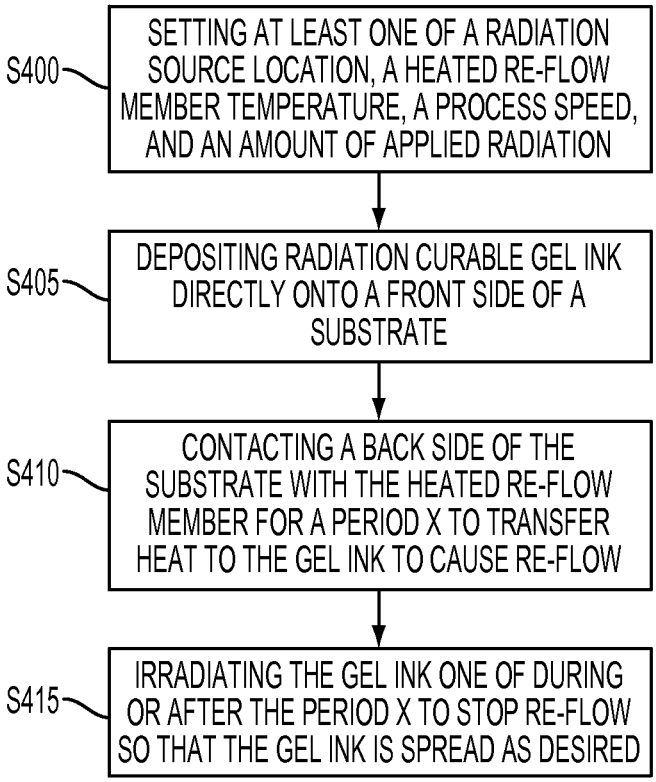
FIG. 4 shows methods for spreading UV gel ink as desired using re-flow and cure optimization processes in accordance with an embodiment.

FIG. 4 shows an embodiment of methods for spreading gel ink as desired. Specifically, FIG. 4 shows setting at least one of a radiation source location, a re-flow member temperature, a process speed, and a radiation emission rate at S401. The setting at S401 may include initially setting at least one of the parameters to a predetermined value. After observing the results of printing and spreading radiation curable gel ink, the parameters may be adjusted as needed to achieve radiation curable gel ink spreading as desired.

For example, using parameters initially set at S401, radiation curable gel ink may be deposited directly onto a substrate such as a paper web at S405. The ink may be deposited by an ink jet print head, for example, directly onto a front side of the substrate. The liquid state gel ink contacts the paper and is quenched to a substantially gel state. To increase a flowability of the ink, the ink may be heated.

For example, at S410, a flowability of the radiation curable gel ink is increased by contact-heating a back side of the substrate to decrease a viscosity of the gel ink, and cause the gel ink to liquefy and spread for a period of time X. The period of time X corresponds to a flow time during which the ink re-flows. As the re-flowed gel ink cools, and transitions back from a liquid state to a gel state, the ink tends to drawback and coalesce.

Accordingly, in the embodiment shown in FIG. 4, the gel ink may be irradiated at S415 to stop re-flow so that the gel ink is spread as desired. Specifically, the irradiating at S415 may include irradiating the gel ink during the flow period X of S410. As such, the ink may irradiated and/or cured before the ink draws back and/or coalesces. The results of S415 may be observed to determine whether the ink has been spread as desired. To improve results and/or achieve an ink spread as desired, at least one of the adjustable parameters may be adjusted and set at S401, and S405, S410, and S415 may be repeated using the set parameter(s) as adjusted. For example, the setting at S401 may include setting at least one adjusted parameter.

While apparatus and systems for radiation curable gel ink spreading are described in relationship to exemplary embodiments, many alternatives, modifications, and variations would be apparent to those skilled in the art. Accordingly, embodiments of methods, apparatus, and systems as set forth herein are intended to be illustrative, not limiting. There are changes that may be made without departing from the spirit and scope of the exemplary embodiments.

It will be appreciated that various of the above-disclosed and other features and functions, or alternatives thereof, may be desirably combined into many other different systems or applications. Also, various alternatives, modifications, variations or improvements therein may be subsequently made by those skilled in the art.

What is claimed is:

1. A radiation curable gel ink spreading method, comprising:

heating a back side of a substrate whereby radiation curable gel ink deposited on a front side of the substrate re-flows.

2. The method of claim 1, comprising:

depositing the radiation curable gel ink directly onto the front side of the substrate.

3. The method of claim 1, comprising:

irradiating the radiation curable gel ink to polymerize an amount of the gel ink.

4. The method of claim 1, the heating further comprising:

contacting the back side of the substrate with a heated re-flow member, the contact member being temperature controlled.

5. The method of claim 3, the irradiating further comprising irradiating the radiation curable gel ink during re-flow of the ink.

6. The method of claim 4, comprising:

separating the substrate from the contact member; and irradiating the re-flowed radiation curable gel ink after the heated re-flow member contacts the substrate.

7. The method of claim 1, the heating further comprising:

contacting the back side of a substrate at a spreading zone with a heated re-flow member, the spreading zone being defined by an area of the substrate wherein the heated re-flow member transfers heat to the substrate.

8. The method of claim 7, comprising:

irradiating the radiation curable ink at the spreading zone, the radiation being emitted from a radiation source, whereby spreading of the re-flowed radiation curable ink is stopped.

9. The method of claim 7, further comprising:

setting the re-flow member temperature to a temperature that will cause re-flow of the gel ink at the spreading zone by contacting the back side of the substrate with the heated re-flow member.

10. The method of claim 9, further comprising:

controlling spreading of the radiation curable gel ink by adjusting at least one of the set re-flow member temperature, a concentration of radiation emitted by the radiation source during the irradiating the radiation curable ink at the spreading zone, a location of the UV source with respect to the spreading zone.

11. A radiation curable gel ink spreading system, comprising:

a print head for depositing radiation curable gel ink directly onto a front side of a substrate; and a re-flow member for contact-heating a back side of the substrate to decreasing a viscosity of the gel ink to cause the ink to re-flow and spread on the front side of the substrate.

12. The system of claim 11, comprising:

a radiation source for irradiating the re-flowed gel ink on the front side of the substrate to polymerize an amount of the gel ink for reducing flowability of the gel ink and preventing further spreading of the ink.

13. The system of claim 12, comprising a location of the radiation source being adjustable for modifying an ink re-flow period, the location of the radiation source being adjustable with respect to at least one of a distance between the radiation source and the substrate, and a distance between the radiation source and the start of a re-flow zone in a process direction, the re-flow zone being defined by an area at which the re-flow member transfers heat through the substrate.

* * * * *